US008168844B2

(12) United States Patent
Arca et al.

(10) Patent No.: US 8,168,844 B2
(45) **Date of Patent: *May 1, 2012**

(54) CATALYTIC COMPOSITIONS FOR THE HIGHLY SELECTIVE HYDRODEALKYLATION OF ALKYLAROMATIC HYDROCARBONS

(75) Inventors: Vittorio Arca, Chioggia (IT); Angelo Boscolo Boscoletto, Sottomarina (IT); Pierluigi Crocetta, Padua (IT)

(73) Assignee: Polimeri Europa S.p.A., San Donato Milanese (IT)

( * ) Notice: Subject to any disclaimer, the term of this patent is extended or adjusted under 35 U.S.C. 154(b) by 535 days.

This patent is subject to a terminal disclaimer.

(21) Appl. No.: 12/375,830

(22) PCT Filed: Aug. 2, 2007

(86) PCT No.: PCT/EP2007/006984

§ 371 (c)(1),
(2), (4) Date: Apr. 2, 2009

(87) PCT Pub. No.: WO2008/015027

PCT Pub. Date: Feb. 7, 2008

(65) Prior Publication Data

US 2009/0272672 A1 Nov. 5, 2009

(30) Foreign Application Priority Data

Aug. 3, 2006 (IT) ..... MI06A1548

(51) Int. Cl.
*C07C 4/18* (2006.01)

(52) U.S. Cl. ..... 585/489; 585/488

(58) Field of Classification Search ..... 585/488, 585/489

See application file for complete search history.

(56) References Cited

U.S. PATENT DOCUMENTS

| | | | |
|---|---|---|---|
| 4,331,822 | A | 5/1982 | Onodera et al. |
| 4,485,185 | A | 11/1984 | Onodera et al. |
| 5,877,374 | A | 3/1999 | Nacamuli et al. |
| 2007/0203377 | A1 | 8/2007 | Arca et al. |
| 2007/0203378 | A1 | 8/2007 | Arca et al. |

FOREIGN PATENT DOCUMENTS

| | | |
|---|---|---|
| EP | 0 138 617 | 4/1985 |
| WO | 98 43932 | 10/1998 |
| WO | 2005 071045 | 8/2005 |

*Primary Examiner* — Thuan Dinh Dang

(74) *Attorney, Agent, or Firm* — Oblon, Spivak, McClelland, Maier & Neustadt, L.L.P.

(57) ABSTRACT

Process for the catalytic hydrodealkylation alone of hydrocarbon compositions comprising $C_8$-$C_{13}$ alkylaromatic compounds mixed with $C_4$-$C_{10}$ aliphatic and cycloaliphatic products which, under the reaction conditions, undergo aromatization and subsequent hydrodealkylation, which comprises treating said hydrocarbon compositions in continuous and in the presence of hydrogen, with a catalyst consisting of a ZSM-5 zeolite, as such or in bound form, wherein the Si/Al molar ratio in the ZSM-5 ranges from 5 to 100, modified by means of the platinum-molybdenum couple, at a temperature ranging from 400 to 650° C., a pressure ranging from 2 to 4 MPa and $H_2$/feedstock molar ratio ranging from 3 to 6. The presence of organic compounds containing heteroatoms such as sulphur, nitrogen or oxygen in the feedstock does not at all alter the performances of the catalyst according to the process object of the invention.

19 Claims, 1 Drawing Sheet

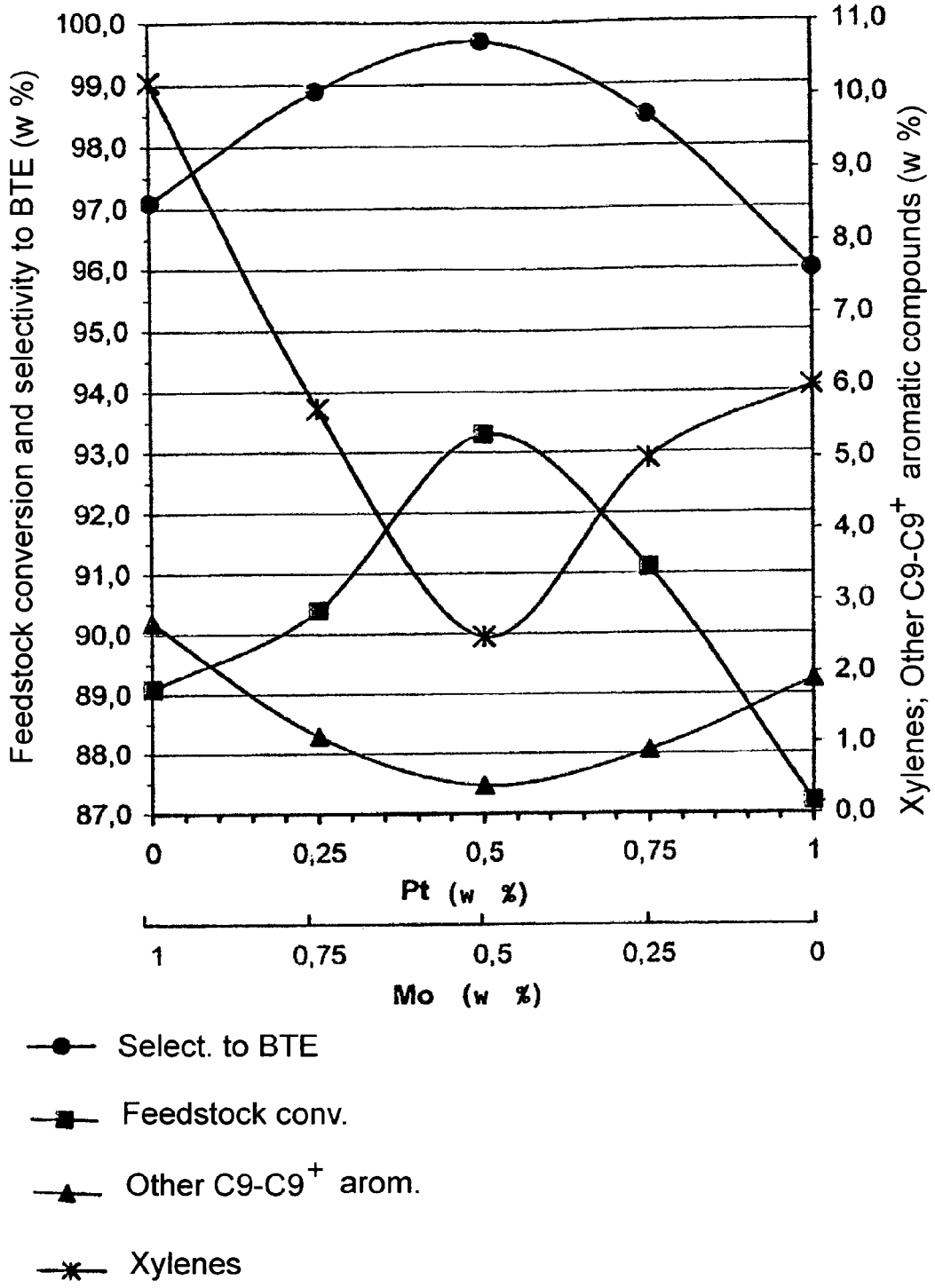
Feedstock conversion and selectivity to BTE (w %)
Xylenes; Other C9-C9+ aromatic compounds (w %)
100,0
99,0
98,0
97,0
96,0
95,0
94,0
93,0
92,0
91,0
90,0
89,0
88,0
87,0
11,0
10,0
9,0
8,0
7,0
6,0
5,0
4,0
3,0
2,0
1,0
0,0
0
0,25
0,5
0,75
1
Pt (w %)
1
0,75
0,5
0,25
0
Mo (w %)
Select. to BTE
Feedstock conv.
Other C9-C9+ arom.
Xylenes

CATALYTIC COMPOSITIONS FOR THE HIGHLY SELECTIVE HYDRODEALKYLATION OF ALKYLAROMATIC HYDROCARBONS

The present invention relates to a process for the catalytic hydrodealkylation of aromatic hydrocarbons.

More specifically, the present invention relates to a process for the catalytic hydrodealkylation of hydrocarbon compositions comprising $C_8$-$C_{13}$ alkylaromatic compounds mixed with $C_4$-$C_{10}$ aliphatic and cycloaliphatic products.

Even more specifically, the present invention relates to a process according to which the catalytic hydrodealkylation operates on alkylaromatic compounds present as such in the initial feedstock and on those produced under the same reaction conditions by the aromatization of aliphatic and cycloaliphatic compounds mixed together. In the overall hydrodealkylation thus obtained, under the conditions object of the invention, concomitant transalkylation, isomerization, disproportioning and condensation by-reactions are quantitatively suppressed. This leads to a very high production of the high-quality products benzene, toluene and ethane (BTE), with a reduced formation of methane, extremely low production of propane and almost null formation of condensed products, essentially of the naphthalene and biphenyl type.

Processes are known in literature for the catalytic hydrodealkylation of alkylaromatic hydrocarbons.

In the European patent 138,617 (Kutz), for example, a process is described for converting alkylaromatic hydrocarbons by hydrodealkylation comprising treating a hydrocarbon stream, essentially consisting of ethylbenzene and xylenes, under conventional reaction conditions, with a zeolite catalyst modified with molybdenum. The process described speaks of hydrodealkylation and/or isomerization of alkylaromatic hydrocarbons. It is evident however that the sole purpose of the process is the selective isomerization of a mixture of xylenes to the para isomer, so that the hydrodealkylation of ethylbenzene becomes only a secondary-reaction with respect to the isomerization of xylenes. Furthermore, the process describes a hydrodealkylation of alkylaromatic compounds which, on the basis of the reaction conditions and results shown, cannot be of a general type, but specific for an exclusive de-ethylation as the only alkylaromatic product which is de-alkylated is ethylbenzene. It is also known that, when a catalytic hydrodealkylation reaction takes place, the hydrogenated alkyl radical (methane, ethane, propane, etc.) which was subjected to catalytic dealkylation from the aromatic ring, must be found in gas phase. Consequently, from the catalytic hydrode-ethylation reaction in question, the corresponding ethane should be obtained as direct proof of the completed dealkylation of the ethyl group, initially bound to the aromatic ring, but there is no evidence of this. The conversion of the ethylbenzene charged, moreover, is always low and, contrary to expectations, decreases when molybdenum, declared as a metal activating hydride-ethylation, is present. Finally, in the process described, the general reaction conditions and by-products formed, clearly show the intervention of undesired isomerization, transalkylation and disproportioning secondary reactions.

Limitations towards a selective catalytic hydrodealkylation also emerge from various other processes described in the known art. In some of these, this reaction, even if mentioned, actually represents a secondary reaction with respect to isomerization, transalkylation, disproportioning reactions and the condensation of alkylaromatic compounds.

In U.S. Pat. No. 4,482,773, for example, a process is described in which the evident objective is to obtain isomerization to p-xylene from a blend of xylenes and ethylbenzene, as its content in the blend is lower than that at equilibrium. The blend is processed under experimental conditions conventionally used for obtaining isomerization reactions. Under these reaction conditions and with a zeolite catalyst modified with platinum and magnesium, the result is the conversion of ethylbenzene to xylenes and the isomerization of these with the sole purpose of enhancing the final content of p-xylene.

U.S. Pat. No. 4,899,011 describes a process in which, once again, the evident objective is to isomerize a hydrocarbon feedstock containing paraffins and a $C_8$ aromatic blend of ethylbenzene and xylenes, as the content of p-xylene is lower than that at equilibrium. The process includes the treatment of said feedstock under conventional reaction conditions, on a catalytic system with two fixed beds, in succession, each of them consisting of a zeolite catalyst of the ZSM-5 type, the first of which has a minimum crystal dimension of 1 μm whereas the second has dimensions lower than 1 μm. The zeolite can be modified by means of a noble metal selected from platinum, palladium or rhodium, or couples of noble metals such as platinum-rhenium, platinum-palladium or platinum-iridium, or terns of the platinum-iridium-rhenium type; or modified by means of the above noble metals and non-noble metals such as cobalt, nickel, vanadium, tungsten, titanium and molybdenum, to form couples of the platinum-nickel or platinum-tungsten type, or terns such as platinum-nickel-tungsten, even if the metal preferred for the impregnation of the ZSM-5 is platinum.

The general reaction conditions lead to the isomerization of xylenes towards the thermal equilibrium composition (richer in p-xylene), and to a partial de-ethylation of the ethylbenzene, as the remaining part is subjected to isomerization to xylenes.

U.S. Pat. No. 5,877,374 describes a process defined as "low pressure", for the hydrodealkylation of ethylbenzene and isomerization of xylenes contained in an aromatic $C_8$ hydrocarbon feedstock in which the p-xylene content is lower than that at equilibrium. This patent includes the processing of said feedstock at a considerably lower pressure (lower than 14 bar) than those generally necessary in hydrodealkylation processes and with a molar ratio between hydrogen and ethylbenzene (1.2 mol/mol) even lower than those mentioned, for example, in U.S. Pat. Nos. 4,482,773 (2-2.2) and 4,899,011 (2.9-3), already much lower with respect to those which have to be used in order to obtain an effective hydrodealkylation, in the presence of a zeolite catalyst of the ZSM-5 type modified with platinum and magnesium. The results, in fact, show that the process unequivocally favours the isomerization of xylenes, whereas the hydrodealkylation of benzene, once again, only partially takes place.

U.S. Pat. No. 6,051,744, very similar to the previous U.S. Pat. No. 5,877,374, envisages the processing of an aromatic $C_8$ hydrocarbon feedstock, mainly consisting of xylenes and ethylbenzene, wherein the p-xylene content in the xylenes of the feedstock is lower than the quantity at equilibrium, operating with an even lower pressure (lower than 8.5 bar) and a reduced hydrogen/ethylbenzene molar ratio (2.9-3) in the presence of a zeolite catalyst of the ZSM-5 type modified with platinum. Also in this case the reaction conditions, particularly concerning the excessively low pressure with respect to that which must be used for obtaining an efficient dealkylating action, only allow a limited hydrodealkylation of ethylbenzene as the isomerization of xylenes and ethylbenzene to p-xylene represents the main reaction.

U.S. Pat. No. 4,351,979 describes a catalytic isomerization/hydrodealkylation process for obtaining the formation of p-xylene from a reformed gasoline containing the three isomers not at equilibrium, in the presence of ethylbenzene and a certain amount of linear and branched paraffins. The catalytic hydrodealkylation of ethylbenzene proves to have a low efficiency and selectivity, under the reaction conditions and with the catalytic system used, consisting of a zeolite of the ZSM-5 type, in acidic form or exchanged with alkaline metals and treated with metals of group VIII, in particular platinum. The low efficiency is demonstrated by the low production of benzene and toluene, and by the significant amount of non-converted ethylbenzene, whereas the poor selectivity is due to the intervention of transalkylation or disproportioning side-reactions, which lead to the formation of higher $C_{9+}$ alkylaromatic products.

U.S. Pat. No. 5,689,027 claims a two-step process, in the first of which the operating conditions should be suitable for the hydrodealkylation of the ethylbenzene present in the feeding, whereas in the second step other operating conditions should promote the isomerization to p-xylene of the blend of isomers present in the feedstock which are not at equilibrium. The catalytic system used in both steps is a ZSM-5 zeolite exchanged with cations of alkaline or alkaline-earth metals, or treated with silanizing agents and subsequently activated with a metal selected from those belonging to group VIII, IB, IIIA and VA, particularly platinum, possibly coupled with tin. A considerable limitation of the process however is the low conversion of ethylbenzene in the first hydrodealkylation step. Two heavy repercussions are the result of this: the considerable quantity of non-converted ethylbenzene which, in the subsequent isomerization step, can jeopardize the shifting of the equilibrium towards the desired increase to p-xylene and, at the same time, promote disproportioning or transalkylation side-reactions to high boiling aromatic products which, if recycled to the first catalytic dealkylation step, further jeopardize the performances.

In U.S. Pat. No. 5,865,986, a catalytic hydrodealkylation section is fed with a gasoline from catalytic reforming, with the purpose of increasing the amount of benzene and toluene to raise the octane number. For this purpose, a zeolite catalyst of the ZSM-5 type is used in the reaction, modified with a single metal selected from cobalt, nickel, tungsten, platinum and palladium. The results claimed however indicate a hydrodealkylation of the reformate having a poor efficacy. Even in the best cases, in the presence of a ZSM-5 modified with platinum or palladium, the increases in concentration per single passage of benzene and toluene, with respect to the feedstock, do not exceed 5% by weight for each of them, whereas an undesired increase of the same amount of xylenes is obtained. Also the reduction of the initial $C_9$ fraction does not exceed 4-5% by weight. The catalytic hydrodealkylation process claimed is therefore characterized by a low dealkylating efficiency, also demonstrated by the fact that the quantity of xylenes increases instead of decreasing, and it also has the drawback of the considerable recycling of the $C_9$ fraction.

Patent WO 2005/071045 describes a process for the catalytic hydrodealkylation of hydrocarbon compositions comprising $C_8$-$C_{13}$ aromatic compounds, possibly mixed with $C_4$-$C_{10}$ aliphatic or cycloaliphatic products, using a catalyst of the ZSM-5 type modified with metals selected among molybdenum, zinc, nickel, cobalt and palladium or couples of molybdenum-zinc and molybdenum-cobalt. The results claimed show an efficient dealkylation with good yields to benzene and toluene. The dealkylation of xylenes and $C_9$-$C_{9+}$ initial aromatic compounds is, in any case, limited.

The Applicant has now surprisingly found a process which allows the hydrodealkylation of $C_8$-$C_{13}$ alkylaromatic hydrocarbons and, unexpectedly, also the contemporaneous catalytic hydrodealkylation of the alkylaromatic compounds obtained from the aromatization, under the same process conditions, as those initially present in a blend as $C_4$-$C_{10}$ aliphatic and cycloaliphatic hydrocarbons, to benzene, toluene and ethane (BTE). Furthermore, the overall hydrodealkylation reaction, object of the present invention, takes place without concomitant transalkylation, disproportioning, isomerization and condensation reactions which always characterize the processes of the known art, by selecting suitable operative conditions and formulation of the zeolite catalyst.

In particular, it has been surprisingly found that, under the operating conditions and with the catalyst composition of the present invention, the hydrodealkylation reaction is not only quantitatively selective towards the formation of benzene, toluene and ethane (BTE), but the benzene/toluene ratio is always clearly favourable to benzene. The economical nature of the process can therefore be attributed to the intrinsic value of both the reaction streams: the liquid phase for the remunerative value of benzene and toluene, particularly benzene, always produced in larger quantities than toluene; the gaseous phase for the possibility of recycling the ethane thus produced in any pyrolysis process, for example for recycling to cracking ovens, with a considerable energy recovery.

An object of the present invention therefore relates to a process capable of operating a selective catalytic hydrodealkylation of hydrocarbon compositions comprising both a $C_8$-$C_{13}$ alkylaromatic fraction and a $C_4$-$C_{10}$ aliphatic fraction which is contemporaneously aromatized under the process conditions. The process object of the present invention therefore allows the catalytic hydrodealkylation to be obtained of the aromatic $C_8$-$C_{10}$ fraction as well as the aromatization of the $C_4$-$C_{10}$ aliphatic and cycloaliphatic fraction present, with subsequent instantaneous hydrodealkylation. According to the process of the present invention, said aromatic and aliphatic-cycloaliphatic hydrocarbon compositions are treated in continuous and in the presence of hydrogen, using a catalyst consisting of a ZSM-5 zeolite carrier, having a Si/Al molar ratio ranging from 5 to 100, modified by the couple of metals molybdenum and platinum (Pt—Mo), at temperatures ranging from 400 to 650° C., preferably from 450 to 580° C., at pressures ranging from 1 to 5 MPa (between 10 and 50 bar), preferably from 2.8 to 3.6 MPa (between 28 and 36 bar), and with $H_2$/feedstock molar ratios ranging from 1 to 10, preferably from 2 to 7, more preferably between 3.8 and 5.2.

In the present invention, the hydrocarbon feedstock subjected to hydrodealkylation comprises $C_8$-$C_{13}$ alkylaromatic compounds, such as ethylbenzene, xylenes, diethylbenzenes, ethylxylenes, trimethylbenzenes, tetramethylbenzenes propylbenzenes, ethyltoluenes, propyltoluenes, butylbenzene, ethylxylenes, etc. This feedstock can come from effluents of reforming units, for example, or from units which effect pyrolysis processes, such as steam cracking, and can contain a blend of aliphatic and cycloaliphatic $C_4$-$C_{10}$ products which, under the process conditions, are aromatized and then hydrodealkylated. The latter can be butanes, pentanes, hexanes, heptanes, etc. and the corresponding cyclic and cycloalkylic derivatives (naphthenes). The feedstock being fed can also contain heteroatomic organic compounds, wherein the heteroatoms can be nitrogen, oxygen and sulphur, in the typical quantities generally present in feedstocks coming from reforming units or pyrolysis processes.

The hydrocarbon feedstock used in the present process can, if required, be subjected to separation treatment, for example distillation or extraction, to concentrate the products to be subjected to subsequent hydrodealkylation. Furthermore, if required, the feedstock can be subjected to a previous hydrogenation to eliminate the unsaturations present in the aliphatic compounds and on the same alkyl substituents of the aromatic rings. Under the hydrodealkylation reaction conditions object of the invention, on the other hand, in particular as a result of the amount of hydrogen used and the activity shown by the catalyst, it is possible to also contemporaneously obtain the direct hydrogenation of the unsaturated compounds present in the aromatic feedstock to be hydrodealkylated, such as butenes, pentenes, alkylpentenes, cyclopentenes, alkylcyclopentenes, hexenes, alkylhexenes, cyclohexenes, alkylcyclohexenes, and so on, and other unsaturated naphthene compounds. Hydrogen itself, under the same reaction conditions, allows the removal of sulphur, nitrogen or oxygen from the compounds typically present in hydrocarbon feedstocks, as these heteroatoms are quantitatively removed (sulphur, for example, as $H_2S$).

According to the present invention, the hydrodealkylation catalyst, consisting on a ZSM-5 zeolite modified with the couples Pt—Mo of the metals platinum and molybdenum ($Pt_x$—$Mo_y$), surprisingly showed the highest selectivity to benzene, toluene and ethane (BTE), with a quantitative reduction of xylenes and, above all, aromatic $C_9$-$C_9^+$ compounds (among $C_9^+$ products, particularly the heavy ones, such as naphthalenes and methylnaphthalenes). Said catalyst, moreover, allowed the underproduction of propane to be minimized, with the consequent simplification of the distillation/separation process from other valuable gases produced by the reaction, methane but, above all, ethane.

The unexpected high conversion and selectivity obtained with the bimetal couple Pt—Mo, lead us to think that a hydrogen spill-over mechanism is strongly enhanced, favoured by the high redox properties of the two metals contemporaneously present, or by their high sensitivity to the reciprocal reduction towards lower oxidation states.

The composition of the zeolite carrier must also have been of considerable help in obtaining such a good results. In particular, the use of a ZSM-5 zeolite particularly rich in aluminium, with Si/Al molar ratios ranging from 5 to 100, preferably from 5 to 70, more preferably between 5 and 35, contributed obtained the desired result. The lack of side-reactions, such as isomerization, transalkylation, condensation and disproportioning in the process object of the invention, is due to the reduction of the undesired acidity of the zeolite (ZSM-5) obtained with the amounts of aluminium found, particularly favourable with respect to silicon.

ZSM-5 zeolite is available on the market or it can be prepared according to the methods described in literature (for example U.S. Pat. Nos. 3,702,886 and 4,139,600). The structure ZSM-5 zeolites is described by Kokotailo et al. (Nature, Vol. 272, page 437, 1978) and by Koningsveld et al. (Acta Cryst. Vol. B43, page 127, 1987; Zeolites, Vol. 10, page 235, 1990).

The zeolitic catalyst is preferably used in bound form in the process of the present invention, adopting a binder which gives it form, consistency and mechanical resistance, so that the zeolite/binder catalyst can be used and suitably moved to an industrial reactor. Examples of binders suitable for the purpose include aluminas, such as pseudobohemite and γ-alumina; clays, such as kaolinite, vermiculite, attapulgite, smectites, montmorillonites; silica; alumino-silicates; titanium and zirconium oxides; combinations of two or more of the above, used in such quantities as to give zeolite/binder weight ratios ranging from 100/1 to 1/10.

The dispersion of the metals in the zeolite or zeolite/binder catalyst can be effected according to conventional techniques, such as impregnation, ionic exchange, vapour deposition, or surface adsorption. The incipient impregnation technique is preferably used, with an aqueous or aqueous-organic solution (the organic solvent preferably being selected from alcohols, ketones and nitrites or blends thereof), containing at least one hydro- and/or organo-soluble compound of the metal, such as to assure a total final content of the metal in the catalyst ranging from 0.05 to 10% by weight, preferably from 0.5 to 4.

The zeolite, with or without binder, is subsequently subjected to impregnation with metals to form the couple $Pt_x$—$Mo_y$, wherein x and y represent the weight percentage of Pt and Mo, respectively. Thanks to this couple of metals, it was unexpectedly found that the performances of the reaction, with respect to the total conversion of the initial feedstock, capacity of contemporaneously aromatizing the aliphatic fraction present which is immediately hydrodealkylated and total selectivity to benzene, toluene and ethane (BTE), proved to be exceptionally high.

In particular, the impregnation comprises treating the zeolite, in or not in bound form, with the solutions of metals in succession or contemporaneously (co-impregnation). The zeolite thus impregnated is dried and then calcined at temperatures ranging from 400 to 650° C. This operation can be repeated according to necessity.

Examples of molybdenum compounds which can be used for this purpose are: molybdenum(II) acetate, ammonium (VI) molybdate, diammonium(III) dimolybdate, ammonium (VI) heptamolybdate, ammonium(VI) phosphomolybdate and analogous salts of sodium and potassium; molybdenum (III) bromide, molybdenum(III)-(V) chloride, molybdenum (VI) fluoride, molybdenum(VI) oxychloride, molybdenum (IV)-(VI) sulphide, molybdenic acid and the corresponding acidic salts of ammonium, sodium and potassium, and molybdenum (II-VI) oxides and others.

As far as platinum is concerned, examples of compounds which can be used are: platinum(II) chloride, platinum(IV) chloride, platinum(II) bromide, platinum(II) iodide, platinum (IV) sulphide, chloroplatinic acid, ammonium hexachloroplatinate(IV), ammonium tetrachloroplatinate(II), potassium hexachloroplatinate(IV), potassium tetrachloroplatinate(II), sodium hexachloroplatinate(IV) hexahydrate, platinum(II) acetylacetonate, platinum(II) hexafluoroacetilacetonate, dichloroethylenediamine platinum(II) tetramino nitrate and, in general, amine complexes of platinum(II) and (IV), wherein the anions can be halides, sulphate, nitrate, nitrite, phosphates, thiocyanate and others.

At the end of the impregnation, the catalyst obtained is $Pt_x$—$Mo_y$/ZSM-5, with a total metal content ranging from 0.05 to 10% by weight, preferably from 0.5 to 4% by weight.

Said catalyst is charged into a fixed-bed reactor fed in continuous with the hydrocarbon feedstock and hydrogen. In this respect, in addition to the control of the experimental parameters described so far, the selection of the flow-rate of the reagents is also absolutely important for obtaining a selective hydrodealkylation of the $C_8$-$C_{13}$ aromatic hydrocarbons and the $C_4$-$C_{10}$ aliphatic/cycloaliphatic hydrocarbons present in a blend and contemporaneously aromatized. The feeding flow-rates of the hydrocarbon mix and hydrogen must be such as to guarantee a LHSV (Liquid Hourly Space Velocity), calculated with respect to the hydrocarbon stream, ranging from 3 to 5 $h^{-1}$, more preferably from 3.5 to 4. 5 $h^{-1}$. For this purpose, the molar ratio between hydrogen and the feedstock fed must remain within the range of 1 and 10 mol/mol, more preferably between 2 and 7 mol/mol, even more preferably between 3.8 and 5.2 mol/mol.

The experimental equipment used comprise a tubular fixed-bed reactor made of stainless steel, with an inner diameter of 20 mm and total height of 84.5 cm with an electric heating oven which forms jackets the reactor. The liquid feedstock is fed to the reactor by means of a high pressure pump. The gaseous reaction effluent is cooled by means of a quench device followed by a gas-liquid separator.

The isothermal section of the reactor, maintained at a constant temperature by automatic control, is charged with the catalyst. The remaining volume of the reactor, above and under the catalytic bed, is filled with granules of an inert solid, corundum for example, whose packing guarantees an optimum distribution and mixing of the gaseous flow of the reagents before the catalytic bed and of the exchanged heat.

A pre-heater positioned before the reactor, operating at a temperature ranging from 200 to 400° C., more preferably from 250 to 320° C., contributes to the optimal contact of the reagents (feedstock and hydrogen) in gaseous phase with the catalyst. This system favours the achievement, in very short times, of isothermal conditions, not limited to the fixed-bed alone, but which are established along the whole reactor allowing an easier and more precise control of the operating temperature of the catalyst. The liquid and gaseous effluents produced by the reaction are separated downstream of the reactor and analyzed by gas chromatography at intervals.

The following examples further illustrate the process according to the present invention and should not be considered as being a limitation of the protection scope of the same as indicated in the enclosed claims.

REFERENCE EXAMPLE TO THE PREPARATION OF CATALYSTS

Catalyst A (Comparative)

A catalyst A is prepared, which is obtained by mixing a ZSM-5 zeolite having a Si/Al molar ratio of 30 and an alumina as binder, the two phases being in a 60/40 weight ratio, and extruding the mixture.

The extruded product is calcined in air at 550° C. for 5 hours and its BET surface area is 290 $m^2/g$. Once this has reached room temperature, it is crushed and sieved to produce a powder having dimension ranging from 20 to 40 mesh (between 0.84 and 0.42 mm), so that 12.4 g of catalyst powder occupy an equivalent volume of 20 ml.

Catalyst B (Comparative)

Catalyst B is obtained by impregnating the catalyst A (30 g) with an aqueous solution (35 ml) containing 0.6 g of tetramino platinum nitrate $(NH_3)_4Pt(NO_3)_2$ at about 25° C. for 16 hours and, subsequently, placed under a nitrogen flow for 12 hours, dried in an oven at 120° C. for 4 hours under vacuum and calcined in air at 550° C. for 5 hours.

The calculated content of molybdenum is 1.0% by weight, with respect to the experimental value, via ICP-MS, of 1.02% by weight.

Catalyst C (Comparative)

Catalyst C is obtained by impregnating the catalyst A (50 g) with an aqueous solution (60 ml) containing 0.92 g of ammonium molybdate $[NH_4)_6Mo_7O_{24}.4H_2O]$ and then following the procedure used for preparing catalyst B.

The content of molybdenum in the catalyst was calculated as being 1.0% by weight, with respect to the value of 1.05% by weight determined by means of ICP-MS analysis.

Catalyst D

Catalyst D is obtained by impregnating catalyst A (50 g) in two steps: a first impregnation with an aqueous solution (60 ml) containing 0.69 g of ammonium molybdate, followed by a second impregnation with an aqueous solution (50 ml) containing 0.25 platinum tetramino nitrate. The impregnation procedure with the first metal is effected as described for catalyst B, but without calcination, followed by impregnation with the second metal with the same operative procedures, followed by the final calcination in air at 550° C. for 5 hours.

The molybdenum and platinum content in the catalyst was calculated as being 0.75% by weight and 0.25% by weight, respectively, compared with the values of 0.76% by weight and 0.23% by weight obtained by ICP-MS. In the preparation of the catalyst, the order of impregnation with the metals can be inverted.

Catalyst E

Catalyst E is obtained by impregnation of catalyst A (20 g) in two steps: a first impregnation with an aqueous solution (24 ml) containing 0.19 g of ammonium molybdate, followed by a second impregnation with an aqueous solution (23 ml) containing 0.2 g of platinum tetramino nitrate. The impregnation procedure with the two metals is effected as described for catalyst D. The impregnation order can be inverted.

The molybdenum and platinum content in the catalyst was calculated as being 0.5% by weight and 0.5% by weight, respectively, compared to the values of 0.52% by weight and 0.49% by weight, respectively, determined by ICP-MS.

Catalyst F

Catalyst F is obtained by impregnation of catalyst A (20 g) in two steps: a first impregnation with an aqueous solution (24 ml) containing 0.10 g of ammonium molybdate, followed by a second impregnation with an aqueous solution (23 ml) containing 0.13 g of platinum tetramino nitrate. The impregnation procedure with the two metals is effected as described for catalyst D. The impregnation order can be inverted.

The molybdenum and platinum content in the catalyst was calculated as being 0.25% by weight and 0.75% by weight, respectively, compared with the values of 0.26% by weight and 0.73% by weight obtained by ICP-MS.

Example 1-6 (1-3 Comparison)

The reactor is charged with 20 $cm^3$ (12. 4 g) of catalyst A, whereas the rest of the volume is filled with corundum in granules, in order to guarantee optimum distribution and mixing of the gaseous flow of reagents and of the heat supplied to the reaction.

A feedstock whose composition is indicated in the following Table 1, is fed to the reactor, suitably mixed with hydrogen and pre-heated to 280° C.

The reaction is carried out at a pressure of 3 MPa, with a reagent feedstock flow-rate which is such as to obtain a LHSV of 3,9-4.1 $h^{-1}$, and a $H_2$/feedstock molar ratio of 4.5.

TABLE 1

Composition of the feeding feedstock

| Compounds | weight % |
|---|---|
| Toluene | 6.6 |
| Ethylbenzene | 31.4 |
| Σ o, m, p-xylene | 10.5 |
| Indane | 16.1 |
| Σ Propylbenzenes (n-, iso-) | 6.9 |
| Σ Ethyltoluenes (2-, 3-, 4-) | 8.8 |
| Σ (Other $C_9$-$C_{9+}$) Aromatic products | 5.1 |
| Σ ($C_4$-$C_{10}$) Aliphatic products | 14.6 |
| Total | 100.0 |

The results are shown in the following Table 2 and refer to the performances obtained by using the catalysts A-C (Comparative examples 1-3) and D-F (Examples 4-6).

The concentration of toluene shown in Table 2 is the net concentration produced by the reaction.

TABLE 2

| | | Example | | | | | |
|---|---|---|---|---|---|---|---|
| | | 1 | 2 | 3 | 4 | 5 | 6 |
| Catalyst | | A | B | C | D | E | F |
| Metal(s) | | — | Pt 1% w | — | Pt 0.25 5 w | Pt 0.50% w | Pt 0.75% w |
| | | — | — | Mo 1% w | Mo 0.75% w | Mo 0.50% w | Mo 0.25% w |
| Reaction temperature (° C.) | | 550 | 550 | 550 | 550 | 550 | 550 |
| Feedstock conversion (%) | | 80.2 | 90.4 | 87.2 | 89.1 | 93.3 | 91.1 |
| Reactor effluent composition % w | | | | | | | |
| Methane | | 10.3 | 3.6 | 4.7 | 4.0 | 3.7 | 3.8 |
| Ethane | | 13.9 | 21.2 | 18.2 | 19.8 | 20.6 | 20.2 |
| Propane | | 2.1 | 0.4 | 2.7 | 0.6 | 0.2 | 0.3 |
| Σ saturated C4-C5 | | — | — | — | — | — | — |
| Ethylbenzene | | 0.9 | — | — | — | — | — |
| Σ o, m, p-xylene | | 13.9 | 6.0 | 10.2 | 5.7 | 2.5 | 5.0 |
| Indane | | — | — | — | — | — | — |
| Σ Propylbenzenes (n-, iso-) | | — | — | — | — | — | — |
| Σ Ethyltoluenes (2-, 3- 4-) | | 1.0 | 0.2 | 0.5 | 0.3 | — | 0.2 |
| Σ (Other C9-C9+) Aromatic products | | 3.0 | 1.9 | 2.7 | 1.1 | 0.4 | 0.9 |
| Σ (C6-C10) Aliphatic products | | 1.5 | 0.1 | 1.3 | 0.2 | 0.2 | 0.1 |
| Benzene | | 25.0 | 35.9 | 36.0 | 38.1 | 43.0 | 39.7 |
| Toluene (*) | | 28.4 | 30.7 | 29.5 | 30.2 | 29.4 | 29.8 |
| Total | | 100.0 | 100.0 | 100.0 | 100.0 | 100.0 | 100.0 |
| Σ (Bz + Tol) | (% w) | 53.4 | 66.6 | 65.5 | 68.3 | 72.4 | 69.5 |
| Selectivity to (Bz + Tol) | (% w) | 66.6 | 73.7 | 75.1 | 76.7 | 77.6 | 76.3 |
| Σ (Bz + Tol + Ethane) | (% w) | 67.3 | 87.8 | 83.7 | 88.1 | 93.0 | 89.7 |
| Selectivity to BTE | (% w) | 83.9 | 97.1 | 96.0 | 98.9 | 99.7 | 98.5 |
| R (Bz/Tol) | | 0.88 | 1.17 | 1.22 | 1.26 | 1.46 | 1.33 |

(*) Net production of the reaction (by subtracting toluene which enters with the feedstock)

The hydrodealkylation reaction carried out at a temperature of 550° C. (see Table 2) shows how the presence of one of the two metals, molybdenum or platinum, in the ZSM-5 (Examples 2 and 3) favours the selective dealkylation of aromatic compounds, inhibiting the side-production of methane in favour of that of ethane, with respect to the reaction carried out with the catalyst as such (ZSM-5, Example 1). The production of benzene and toluene is also increased and their ratio (benzene/toluene) becomes favourable to benzene.

When the hydrodealkylation reaction is carried out with ZSM-5, on the other hand, in which, according to the invention, the two metals molybdenum and platinum are contemporaneously present ($Pt_x$—$Mo_y$/ZSM-5), even better results are surprisingly obtained (Example 4-6) than those obtained with the two metals individually present (Examples 2 and 3) and decisively higher than those obtained with ZSM-5 alone.

In addition to higher conversions of the feedstock with net productions of benzene, toluene and ethane (BTE), FIG. 1, an unexpected drastic reduction in propane is obtained, with all the energy benefits deriving from the fractionation of such limited quantities of this gas with respect to the other valuable gases produced, methane and, above all, ethane.

The high dealkylating capacity observed with reference to the composition of the reaction gas, also has parallel confirmation in the reaction liquid composition. In particular, there is a definite reduction in xylenes ($C_8$) and heavy aromatic products ($C_9$-$C_{9+}$) initially present (FIG. 1).

This result is particularly important as it demonstrates that the amount of xylenes and higher aromatic compounds ($C_9$-$C_{9+}$) converted per single passage by the process object of the invention, is such as to sustain the recycling of what remains in the effluent, thus allowing minimum and occasional flushings. The activity exerted towards the aliphatic fraction, on which a quantitative conversion is obtained thanks to the aromatizing capacity of the catalyst which allows the subsequent dealkylation, is also extremely relevant.

As far as the process is concerned, this leads to a further advantage downstream, as the volumes necessary for a typical extraction section for the separation of the aromatic compounds from the non-converted aliphatic compounds can be eliminated or drastically reduced. The other advantage is upstream of the process, as the necessity is eliminated of a separation before the reaction between the aromatic and aliphatic component, with all the flexibility that such a process offers, as feedstocks of various aromatic/aliphatic compositions can be processed.

As far as the presence of hetero-atoms is concerned, such as nitrogen, oxygen and sulphur, usually present as organic compounds in the feedstocks to be treated, it has been observed that these are quantitatively removed under the process conditions.

Examples are indicated in Table 3 relating to hydrodealkylation reactions carried out as in the previous examples, with the substantial difference that sulphur is added to the feedstock in the form of dimethyldisulphide (DMDS). The corresponding hydrodesulphurizing efficacy of the catalytic system $Pt_x$—$Mo_y$/ZSM-5, object of the present invention, is confirmed by the fact that the corresponding $H_2S$ remains, on the whole, lower than 0.1 ppm/p in the reaction effluent.

TABLE 3

| | | Example | | | | | |
|---|---|---|---|---|---|---|---|
| | | 4 | 4A | 5 | 5A | 6 | 6A |
| Catalyst | | D | | E | | F | |
| Metals | | Pt 0.25% w Mo 0.75% w | | Pt 0.50% w Mo 0.50% w | | Pt 0.75% w Mo 0.25% w | |
| Reaction temperature | (° C.) | 550 | | 550 | | 550 | |
| Presence of DMDS* | (ppm/p) | — | 200 | — | 200 | — | 200 |
| Feedstock conversion | (%) | 89.1 | 88.7 | 93.3 | 92.7 | 91.1 | 91.3 |

TABLE 3-continued

| | | Example | | | | | |
|---|---|---|---|---|---|---|---|
| | | 4 | 4A | 5 | 5A | 6 | 6A |
| Ethane | | 19.8 | 19.6 | 20.6 | 20.0 | 20.2 | 19.8 |
| Benzene | | 38.1 | 37.7 | 43.0 | 42.2 | 39.7 | 39.1 |
| Toluene | | 30.2 | 30.3 | 29.4 | 29.8 | 29.8 | 30.3 |
| Σ (Bz + Tol) | (% w) | 68.3 | 68.0 | 72.4 | 72.0 | 69.5 | 69.4 |
| Selectivity to (Bz + Tol) | (% w) | 76.7 | 76.6 | 77.6 | 77.7 | 76.3 | 76.0 |
| Σ (Bz + Tol + Ethane) | (% w) | 88.1 | 87.6 | 93.0 | 92.0 | 89.7 | 89.2 |
| Selectivity to BTE | (% w) | 98.9 | 98.7 | 99.7 | 99.2 | 98.5 | 97.7 |
| R (Bz/Tol) | | 1.26 | 1.24 | 1.46 | 1.42 | 1.33 | 1.29 |

*= Equal to 136 ppm/p as sulphur equivalent

The invention claimed is:

1. A process for catalytic hydrodealkylation of a hydrocarbon composition comprising a $C_8$-$C_{13}$ alkylaromatic compound mixed with a $C_4$-$C_{10}$ aliphatic compound, wherein said process comprises continuously reacting said composition in the presence of hydrogen and a catalyst at a temperature of from 400 to 650° C., a pressure of from 1 to 5 MPa and a $H_2$/composition molar ratio of from 1 to 10, wherein the catalyst comprises a ZSM-5 zeolite which has been modified with platinum-molybdenum and has a Si/Al molar ratio within the range of 5 to 100.

2. The process according to claim 1, wherein the hydrodealkylation reaction takes place at a temperature of from 450 to 580° C., a pressure of from 2.8 to 3.6 MPa, a $H_2$/composition molar ratio of from 3.8 to 5.2, and wherein the composition has a flow-rate having a LHSV (Liquid Hourly Space Velocity), calculated on the hydrocarbon stream, from 3 to 5 $h^{-1}$.

3. The process according to claim 1 or 2, wherein a feedstock comprising the $C_8$-$C_{13}$ alkylaromatic hydrocarbon comes from a reforming unit or a unit which effects pyrolysis processes, or from steam-cracking.

4. The process according to claim 1, wherein the hydrocarbon composition subjected to hydrodealkylation comprises a $C_8$-$C_{13}$ alkylaromatic compound mixed with a $C_4$-$C_{10}$ aliphatic compound, wherein the $C_4$-$C_{10}$ aliphatic compound is aromatized and then hydrodealkylated under the process conditions, and an organic compound containing heteroatoms.

5. The process according to claim 4, wherein the hydrocarbon composition subjected to hydrodealkylation comprises at least one $C_8$-$C_{13}$ alkylaromatic compound selected from the group consisting of ethylbenzene xylene, propylbenzene, ethyltoluene, trimethylbenzene, diethylbenzene, ethylxylene, tetramethylbenzene, propyltoluene, ethyltrimethylbenzene, triethylbenzene, and dipropyltoluene, and at least one $C_4$-$C_{10}$ aliphatic compound which, under the process conditions, is aromatized and then hydrodealkylated.

6. The process according to claim 1, wherein the catalyst comprises a ZSM-5 zeolite in bound form, bonded with at least one binder selected from the group consisting of alumina, clay, silica, alumino-silicate, titanium oxide and zirconium oxide, wherein the zeolite/binder weight ratio is from 100/1 to 1/10.

7. The process according to claim 1, wherein the ZSM-5 zeolite has a Si/Al molar ratio of from 5 to 70.

8. The process according to claim 1, wherein the platinum-molybdenum modification on the catalyst is carried out according to a process selected from the group consisting of impregnation, ion exchange, vapour deposition and surface adsorption.

9. The process according to claim 1, wherein the ZSM-5 zeolite is impregnated with solutions of the salts of the above-mentioned metals platinum and molybdenum, subsequently dried and then calcined at a temperature of from 400 to 650° C., to obtain a $Pt_x$-$Mo_y$/ZSM-5 catalyst.

10. The process according to claim 9, wherein the impregnation of the ZSM-5 zeolite is effected using an aqueous or aqueous-organic solution comprising an organic solvent selected from the group consisting of an alcohol, a ketone, a nitrile and mixtures thereof, and a hydro- or organo-soluble compound of the metals, in such a concentration that the overall metal content in the catalyst is from 0.1 to 10% by weight.

11. The process according to claim 10, wherein the overall content of the metals platinum and molybdenum is from 0.5 to 4% by weight.

12. The process according to claim 1, wherein the $C_4$-$C_{10}$ aliphatic compound is a $C_4$-$C_{10}$ cycloaliphatic compound.

13. The process according to claim 1, wherein the composition has a LHSV (Liquid Hourly Space Velocity), calculated on the hydrocarbon stream, of from 3 to 5 $h^{-1}$.

14. The process according to claim 4, wherein the hydrocarbon composition subjected to hydrodealkylation comprises a $C_4$-$C_{10}$ aliphatic compound selected from the group consisting of butane, pentane, hexane and heptane.

15. The process according to claim 6, wherein the binder is an alumina selected from the group consisting of pseudobohemite and γ-alumina.

16. The process according to claim 6, wherein the binder is a clay selected from the group consisting of kaolinite, smectite and montmorillonite.

17. The process according to claim 1, wherein the ZSM-5 zeolite has a Si/Al molar ratio of from 5 to 35.

18. The process according to claim 9 wherein the ZSM-5 zeolite is in bound form.

19. The process according to any of the previous claims claim 1, wherein the overall content of the metals platinum and molybdenum is from 0.1 to 10% by weight.

* * * * *